US006715324B2

(12) United States Patent
Okamoto

(10) Patent No.: US 6,715,324 B2
(45) Date of Patent: Apr. 6, 2004

(54) METHOD OF KNITTING STRIPE PATTERN OF TUBULAR KNITTED FABRIC, AND THE KNITTED FABRIC

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/181,934

(22) PCT Filed: Feb. 13, 2001

(86) PCT No.: PCT/JP01/00996

§ 371 (c)(1),
(2), (4) Date: Jul. 30, 2002

(87) PCT Pub. No.: WO01/61092

PCT Pub. Date: Aug. 23, 2001

(65) Prior Publication Data

US 2003/0010069 A1 Jan. 16, 2003

(30) Foreign Application Priority Data

Feb. 17, 2000 (JP) ..... 2000-039698

(51) Int. Cl.[7] ..... D04B 7/04
(52) U.S. Cl. ..... 66/64
(58) Field of Search ..... 66/64, 69, 169 R, 66/170, 180, 196, 75.1

(56) References Cited

U.S. PATENT DOCUMENTS 2,375,474 A 5/1945 Holmes et al.
3,990,271 A * 11/1976 Jeffcoat ..... 66/176
4,087,991 A * 5/1978 Robinson et al. ..... 66/189
4,111,009 A * 9/1978 Robinson et al. ..... 66/189
4,287,728 A * 9/1981 Schmid et al. ..... 66/125 R

FOREIGN PATENT DOCUMENTS

| | | |
|---|---|---|
| EP | 0 699 791 A1 | 3/1996 |
| EP | 0 854 219 A3 | 7/1998 |
| EP | 1 219 740 A1 | 7/2002 |
| JP | 8-188942 | 7/1996 |
| JP | 10-60758 | 3/1998 |

* cited by examiner

*Primary Examiner*—Danny Worrell
(74) *Attorney, Agent, or Firm*—Rothwell, Figg, Ernst & Manbeck

(57) ABSTRACT

A method of knitting a stripe pattern in a tubular fabric by using a flat knitting machine comprising at least a pair of front and back needle beds, wherein a front fabric 3 and a back fabric 5 are suspended in layers from the needle beds and their loop courses are cyclically knitted in an alternate order so as to be joined together at each widthwise end thereof to form the tubular fabric 1; wherein whenever a predetermined courses are knitted, two different yarns of a first yarn and a second yarn are switched to each other alternately to form the stripe pattern comprising a first knitted fabric part 7 and a second knitted fabric part 9; and wherein a loop of at least either of the first knitted fabric part and the second knitted fabric part is missed at a yarn switching point in the boundary between the first knitted fabric part 7 and the second knitted fabric part 9, to minimize a stitch level difference produced at that point.

10 Claims, 7 Drawing Sheets

METHOD OF KNITTING STRIPE PATTERN OF TUBULAR KNITTED FABRIC, AND THE KNITTED FABRIC

TECHNICAL FIELD

The present invention relates to a knitting method of knitting a stripe pattern into a tubular fabric by using a flat knitting machine, wherein a yarn switching is performed in the course of knitting of the tubular fabric to minimize stitch level difference produced at the yarn switching point, so as to prevent disfigurement of the knitted fabric, and to the stripe patterned fabric.

BACKGROUND ART

A tubular fabric can be knitted by using a flat knitting machine in such a manner that a front knitted fabric and a back knitted fabric are suspended in layers from their respective needle beds and their loop courses are cyclically knitted, with a yarn fed to the front fabric and the back fabric in an alternate order, so as to be joined together at each widthwise end thereof.

An example of a general method of knitting a tubular fabric of a plain knitted structure by using the flat knitting machine is shown in FIG. 5. "F" at the left side of the diagram indicates a front needle bed, "B" indicates a back needle bed, "A–O" indicate needles of the front needle bed, and "a–o" indicate needles of the back needle bed. FIG. 6 is a loop diagram showing in development a part of the knitted fabric part around the yarn switching point. In FIG. 6, the broken line X—X shows a boundary between a front fabric 103 and a back fabric 105, which corresponds to a left end portion of the knitting width of the fabric, when viewed from on the needle bed. FIG. 6 illustrates that the loop course of the front fabric 103 and the loop course of the back fabric 105 which are formed in one knitting cycle of the tubular fabric are aligned on the same line.

First, in the step 1, a yarn feeder is shifted rightwards to feed the yarn to the needles a–o of the back needle bed so as to make the course knitting of the back fabric 105. In the next step 2, the yarn feeder is shifted leftwards to feed the yarn to the needles O–A of the front needle bed so as to make the course knitting of the front fabric 103. Subsequently, the course knitting in the step 1 and the course knitting in the step 2 are repeated in an adequate number of times to knit the loop courses of a first knitted fabric part 107. Thereafter, the yarn is switched to another yarn of different color and then the same knitting as the knitting mentioned above is made to knit a second knitted fabric part 109. This knitting way that whenever a required number of cycles of courses are knitted, the yarns are alternately switched to each other can produce a stripe patterned tubular fabric 101 in which the first color and the second color are alternately mixed. It should be noted that the stripe patterned fabric defined herein includes a two-tone knitted fabric in which the yarn switching is performed only once. In general, the yarn feeder is initially positioned at either lengthwise end of the needle bed of the flat knitting machine. In this example, the initial position of the yarn feeder is set at the left side of the same and the wale at the left end of the back fabric 105 (at the needle "a" of the back needle bed) is set to be a starting point of the knitting cycle. The yarn switching is performed in this condition in the illustrated example.

As seen from FIG. 6, when a next loop course is formed after the loop course of the tubular fabric 101 is formed in one cycle knitting, the last loop in the loop course formed in the one cycle knitting is drawn toward a firstly formed loop in the next loop course formed in one cycle knitting. As a result of this, color transition difference is produced at the yarn switching point 102 in the actual knitted fabric, as shown in FIG. 7.

In addition, since cross-over yarns 120, 121 are produced at the yarn switching point at which the cycle knitting begins, it is necessary that after knitting, the cross-over yarns 120, 121 are cut and their edge yarns are drawn into the inside of the tubular fabric 101. Further, a tail end process, such as a darning, is required to prevent the stitches from loosening from the edge yarn thus drawn in.

Thus, when the tubular fabric 101 mixing the stripe pattern therein is knitted in the conventional knitting method, the stitch level difference resulting from the yarn switching is produced distinctively at the boundary between the front fabric 103 and the back fabric 105, thus disfiguring the appearance of the knitted fabric.

Also, since the knitting involving the yarn switching produces the cross-over yarns at the yarn switching point, it involves troublesome tail end process as mentioned above.

In the light of these problems, the applicant of this application previously proposed the method disclosed in Japanese Laid-open (Unexamined) Patent Publication No. Hei 10 (1998)-60758. However, the proposed method is a tubular fabric knitting method wherein the yarn switching point is set at an obscure point of a knitted product, rather than at an end of the knitted product with respect to the knitting width thereof. For example, when a necktie is knitted, the yarn switching point is set at a hidden place on the back side of the necktie. Hence, the previously proposed method is not intended for minimizing the occurrence of the stitch level difference itself. In view of this, the previously proposed method cannot be useful for the seamless knitting of tubular knitwear, such as a sweater and a skirt, having no place for the yarn switching point to be hidden on the back side, unlike a necktie.

It is the object of the present invention to provide a tubular fabric with a stripe pattern that provides a minimized color transition difference resulting from the yarn switching produced at the yarn switching point, to prevent disfigurement of the knitted fabric. It is another object of the present invention to provide a tubular fabric with a stripe pattern that can relieve the tail end process of an edge yarn portion including cross-over yarns produced by the yarn switching.

DISCLOSURE OF THE INVENTION

The present invention provides a method of knitting a stripe pattern in a tubular fabric by using a flat knitting machine comprising at least a pair of front and back needle beds, wherein a front fabric and a back fabric are suspended in layers from the needle beds and their loop courses are cyclically knitted in an alternate order so as to be joined together at each widthwise end thereof, so as to form the tubular fabric; wherein whenever a predetermined courses are knitted, a yarn switching is performed to form the stripe pattern comprising at least a first knitted fabric part and a second knitted fabric part; and wherein a loop of at least either of the first knitted fabric part and the second knitted fabric part is missed and/or tucked at a yarn switching point in the boundary between the first knitted fabric part and the second knitted fabric part, to minimize a stitch level difference produced at that point.

Preferably, at least one loop of adjacent loops in each of the first knitted fabric part and the second knitted fabric part is missed at the yarn switching point.

Further preferably, two loops of the adjacent loops in each of the first knitted fabric part and the second knitted fabric part are missed at the yarn switching point.

Still further preferably, one of the two loops is missed in the knitting of the last but one course of the first knitted fabric part; then the other of the two loops is missed in the last course of the same; then one of the two loops is missed in the knitting of the first course of the second knitted fabric part knitted subsequently; and then the other of the two loops is missed in the sequent knitting of the course of the same.

It is preferable that the method includes the unused yarn edge disposal knitting step that loops to dispose unused yarn edges are formed in the first and second knitted fabric parts at portions thereof in proximity of casting-on and casting-off by using empty needles and then the loops thus formed are laid over given loops in the tubular fabric.

It is further preferable that the loops, which are formed in the knitted fabric parts on casting-off side thereof to dispose unused yarn edges, are laid over the downstream located loops with respect to the knitting direction, and the loops, which are formed in the knitted fabric parts on casting-on side thereof to dispose unused yarn edges, are laid over the upstream located loops with respect to the knitting direction.

Also, the present invention provides a method of knitting a stripe pattern in a tubular fabric by using a flat knitting machine comprising at least a pair of front and back needle beds, wherein a front fabric and a back fabric are suspended in layers from the needle beds and their loops courses are cyclically knitted in an alternate order so as to be joined together at each widthwise end thereof, so as to form the tubular fabric; and wherein a yarn switching is performed to knit the stripe pattern comprising at least a first knitted fabric part and a second knitted fabric part, the method comprising the steps:

a) that a loop of the first knitted fabric part at a portion thereof on the casting-off side next to the second knitted fabric part to be knitted next is missed and/or tucked; and b) that a loop of the second knitted fabric part at a portion thereof on the casting-on side next to the first knitted fabric part is missed and/or tucked in succession to said step.

Further, the present invention provides a tubular fabric with a stripe pattern, wherein a front fabric and a back fabric are cyclically knitted so as to be joined together at each widthwise end thereof; wherein the stripe pattern comprising at least a first knitted fabric part and a second knitted fabric part is formed in such a manner that whenever a predetermined courses are knitted, two different yarns of a first yarn and a second yarn are switched to each other alternately; and wherein at least either of the first knitted fabric part and the second knitted fabric part is missed and/or tucked at a yarn switching point in the boundary between the first knitted fabric part and the second knitted fabric part.

Preferably, at least one loop of adjacent loops in each of the first knitted fabric part and the second knitted fabric part is missed at the yarn switching point.

Further preferably, two loops of the adjacent loops in each of the first knitted fabric part and the second knitted fabric part are missed at the yarn switching point in such a manner that one of the two loops is missed in the last but one course of the first knitted fabric part; then the other of the two loops is missed in the last course of the same; then one of the two loops is missed in the first course of the second knitted fabric part knitted subsequently; and then the other of the two loops is missed in the sequent loop course of the same.

According to the present invention, the tubular fabric with a stripe pattern comprising at least a first knitted fabric part knitted with a first yarn and a second knitted fabric part knitted with a second yarn is knitted in such a manner that when the knitting is switched from the first knitted fabric part to the second knitted fabric part and vice versa, the needle next to the yarn switching point in at least either of the knitted fabric parts on the cast-on side or the cast-off side is put in the miss position or the tuck position or in the combined position, without feeding the yarn to that needle. As a result of this, the number of courses of the wale (stitch loops) bordering on the yarn switching point is reduced more than the number of courses of the other wale and, as a result of this, the loops formed in the course knitting before and after the miss or the tuck knitting are pulled in each other vertically and thus stretched, thus serving to make the color difference produced at the yarn switching point obscure.

In the case where one loop of adjacent loops in each of the first knitted fabric part and the second knitted fabric part is missed, the color difference is absorbed between the two missed wale. Thus, the color difference can be made obscure, as compared with the case where one loop in only one knitted fabric part is missed.

In the case where two loops of the adjacent loops in each of the first knitted fabric part and the second knitted fabric part are missed at the yarn switching point, or preferably in the case where one of the two loops is missed in the last but one course of the first knitted fabric part; then the other of the two loops is missed in the last course of the same; then one of the two loops is missed in the first course of the second knitted fabric part knitted subsequently; and then the other of the two loops is missed in the sequent loop course of the same, the color difference is gradually absorbed among the four missed wale. Thus, the color difference can be made further obscure, as compared with the case where one loop is missed.

When an unused yarn edge disposing loop is formed at the yarn switching by using the empty needle located next to the yarn switching point and the loop thus formed is laid over a given loop in the tubular fabric, the unused yarn edge disposing loop is woven into the fabric in the sequent course knitting, thus preventing the stitches of the fabric from loosening therefrom.

When the unused yarn edge disposing loop formed in the knitted fabric part at a portion thereof on the cast-off side is laid over the loop located downstream with respect to the knitting direction and the unused yarn edge disposing loop formed in the knitted fabric part at a portion thereof on the cast-on side is laid over the loop located upstream with respect to the knitting direction, these unused yarn edge disposing loops can allow the loops formed at the cast-off and cast-on positions to be interconnected in one course direction as well as in the horizontal direction, and as such can prevent forming any undesirable hole thereat.

BEST MODE FOR CARRYING OUT THE INVENTION

Certain preferred embodiments of the present invention will be described with reference to the accompanying drawings.

Embodiment 1

Figure 1:
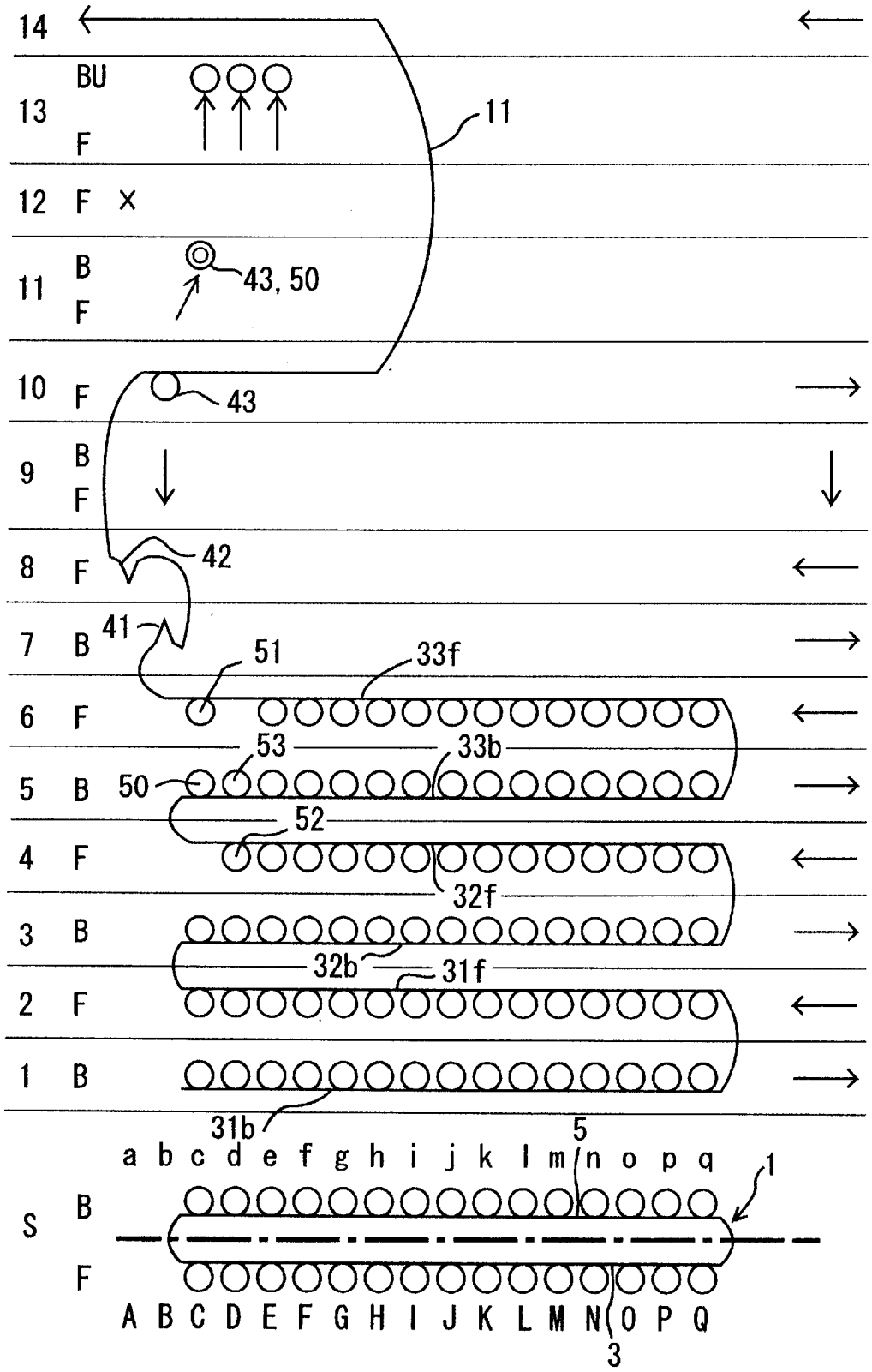
FIG. 1 shows the knitting steps 1–14 of a tubular fabric having a striped pattern knitted in the method of Embodiment 1.
Figure 2:
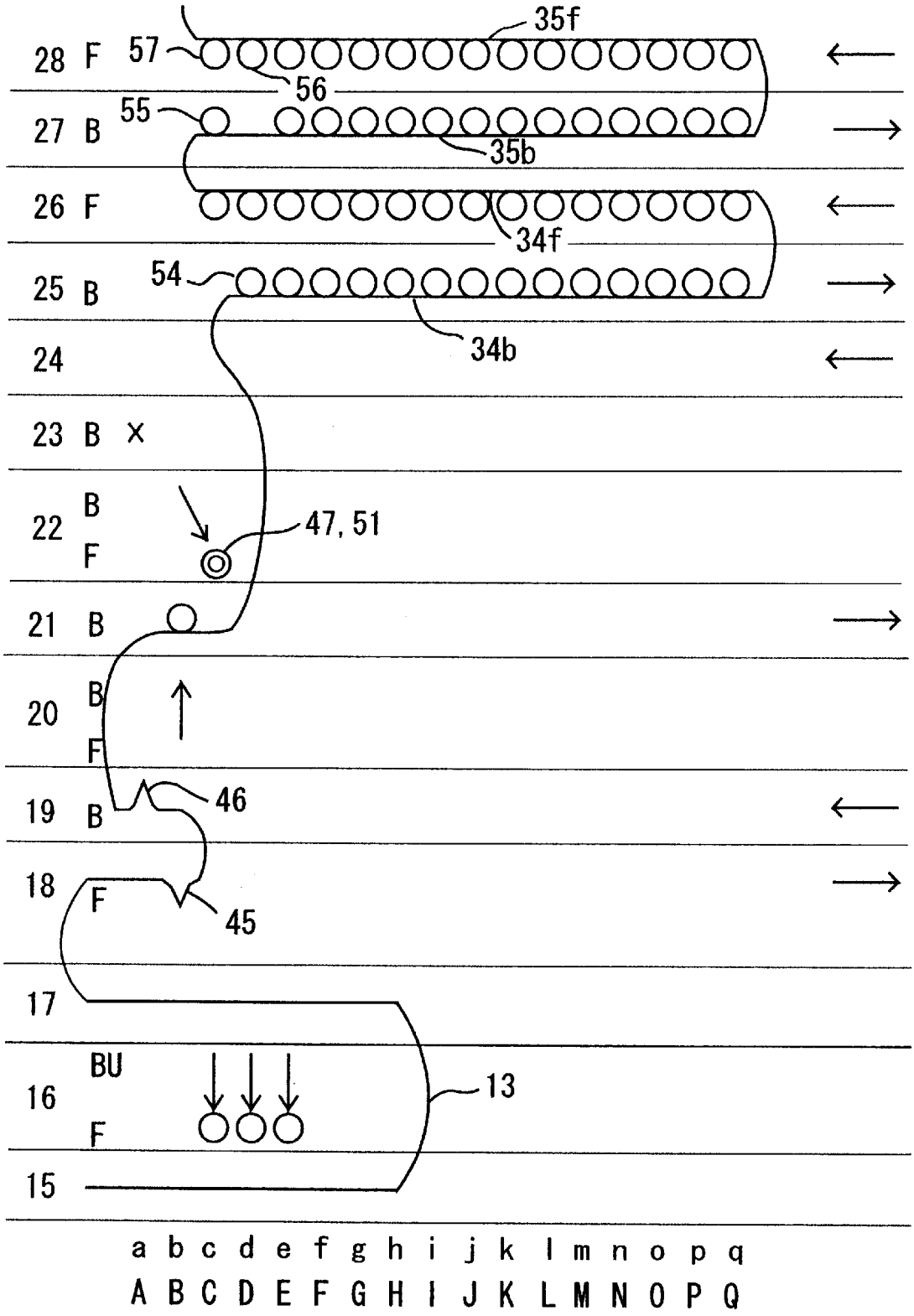
FIG. 2 shows the knitting steps 15–28.
Figure 3:
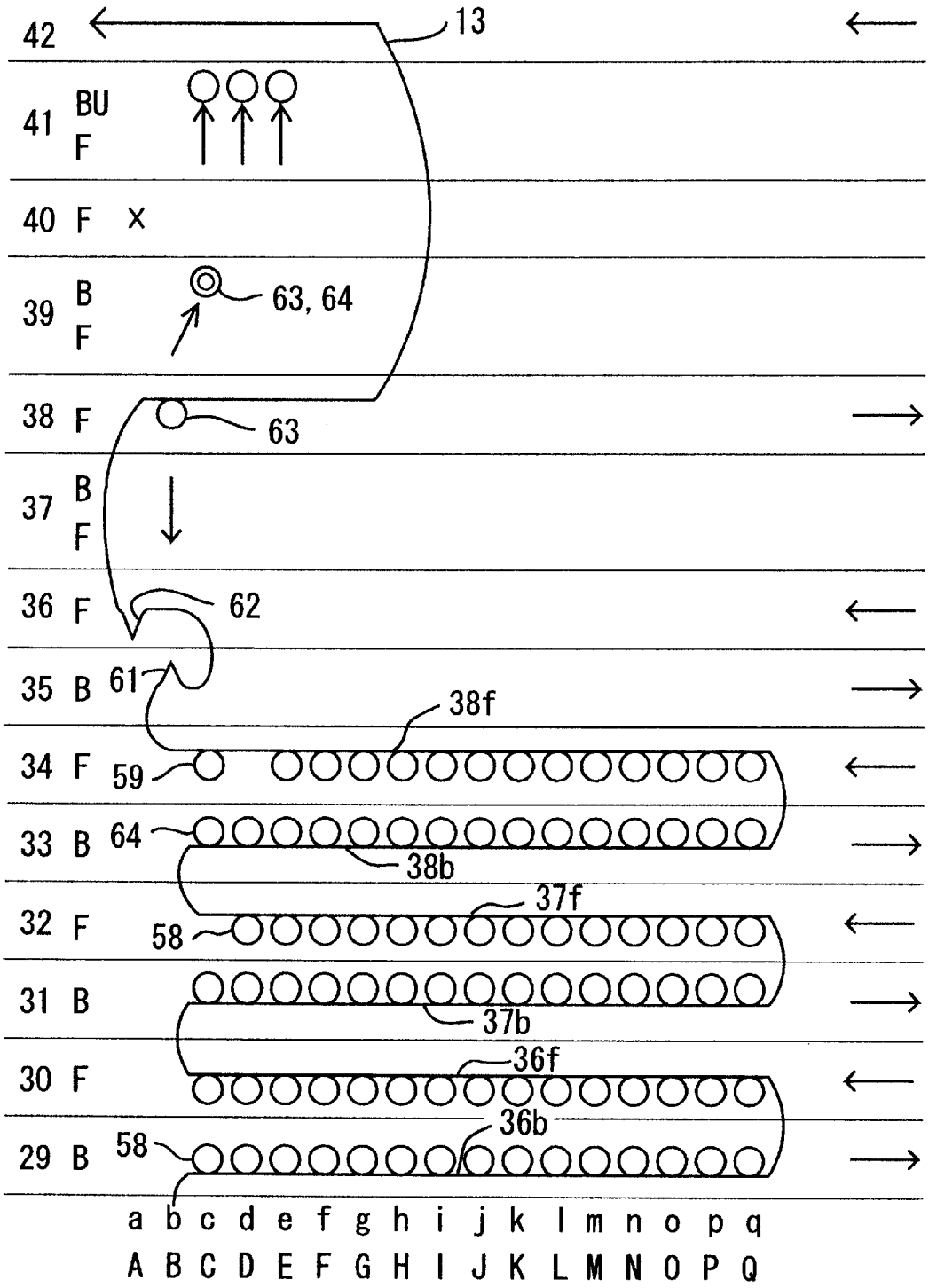
FIG. 3 shows the knitting steps 29–42.
Figure 4:
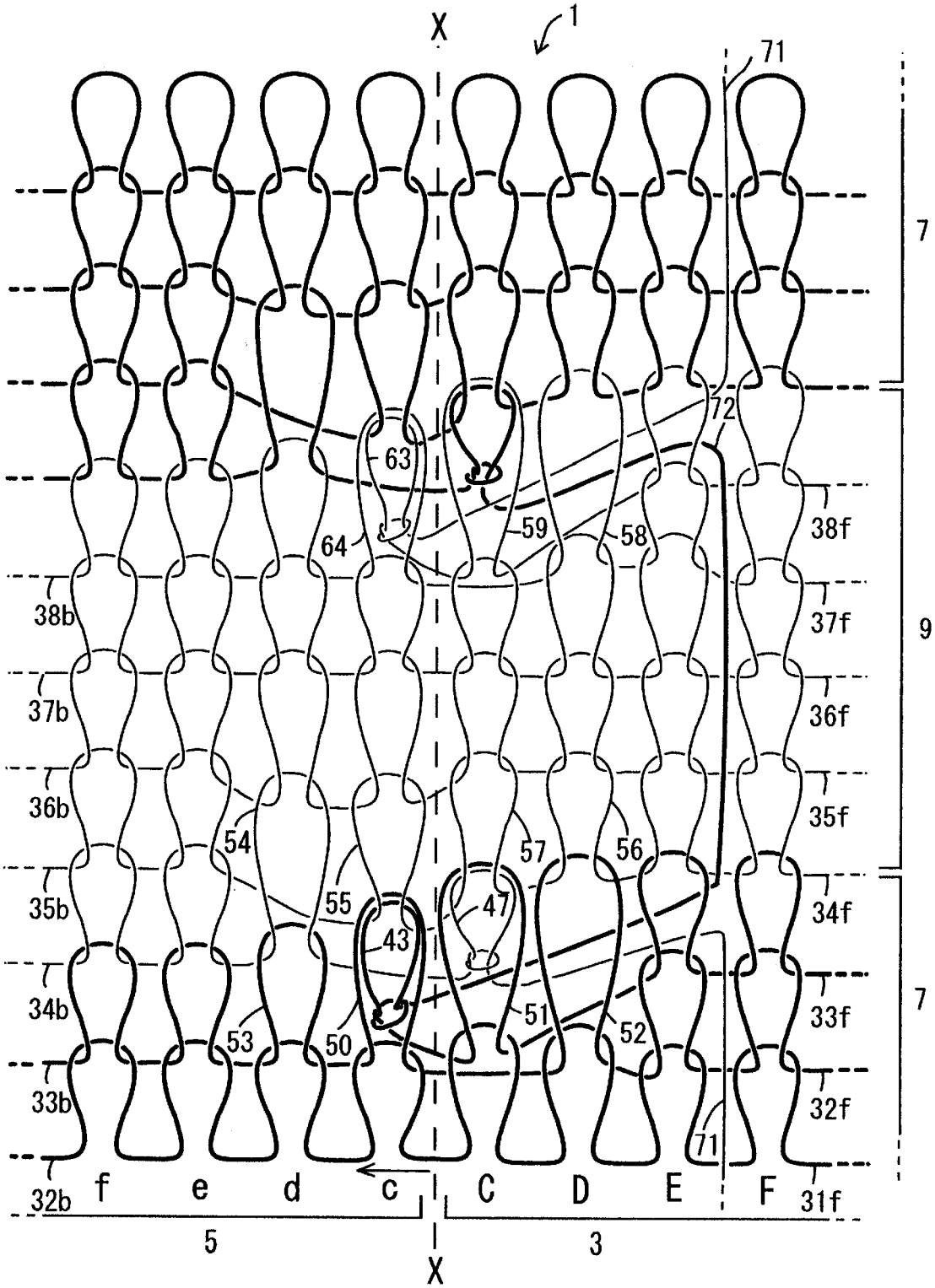
FIG. 4 is a loop diagram showing a knitted loop structure around a yarn switching point of the tubular fabric knitted in the method of Embodiment 1.
Figure 5:
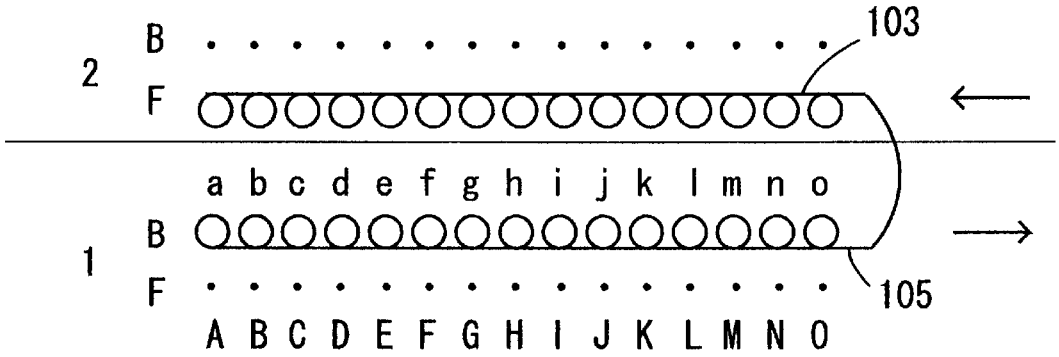
FIG. 5 shows a general knitting method of knitting the tubular fabric by using a flat knitting machine.
Figure 6:
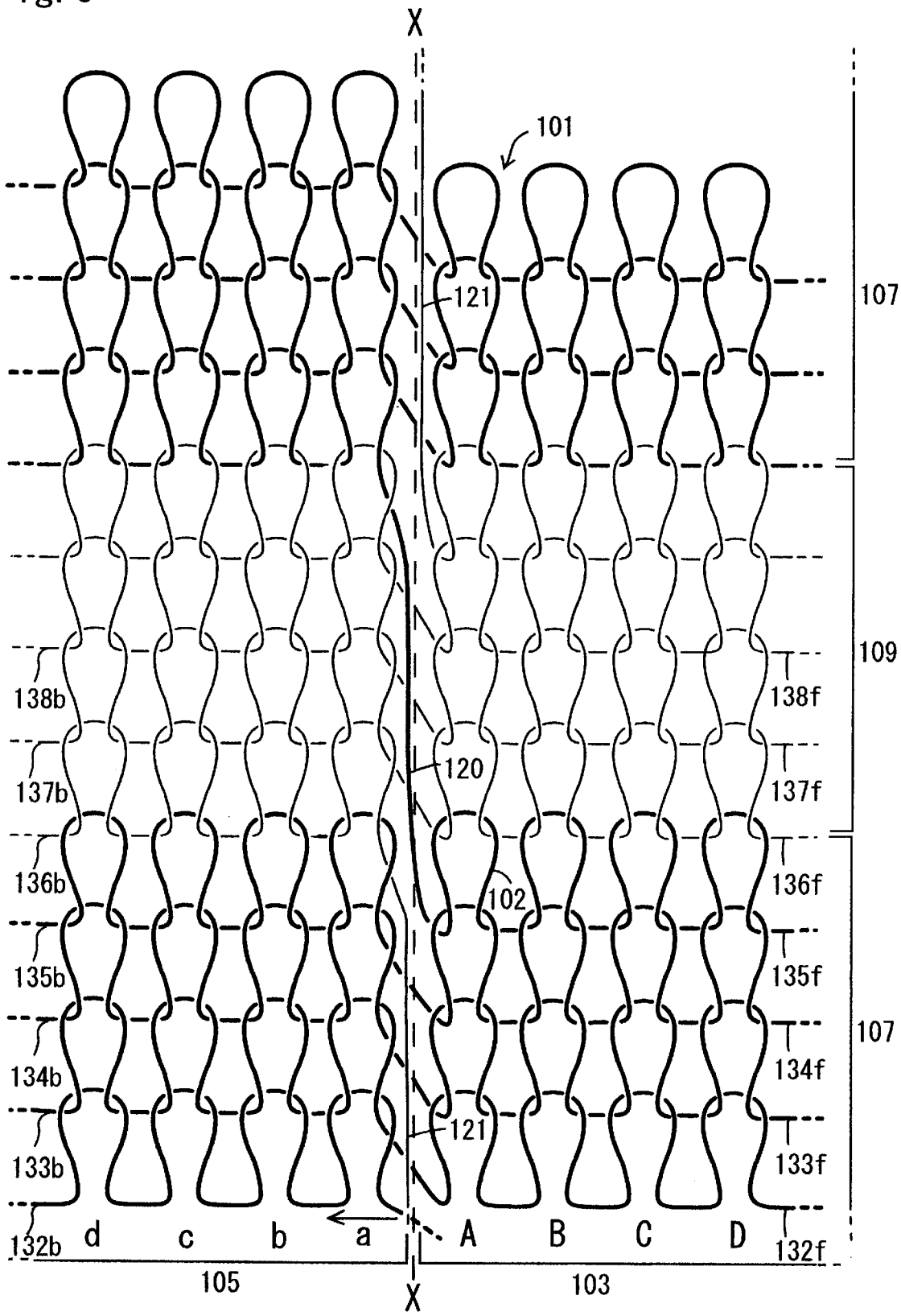
FIG. 6 is a loop diagram showing the knitted loop structure around a yarn switching point of the tubular fabric having a stripe pattern knitted in the conventional method, depicting the respective courses aligned in the same lines.
Figure 7:
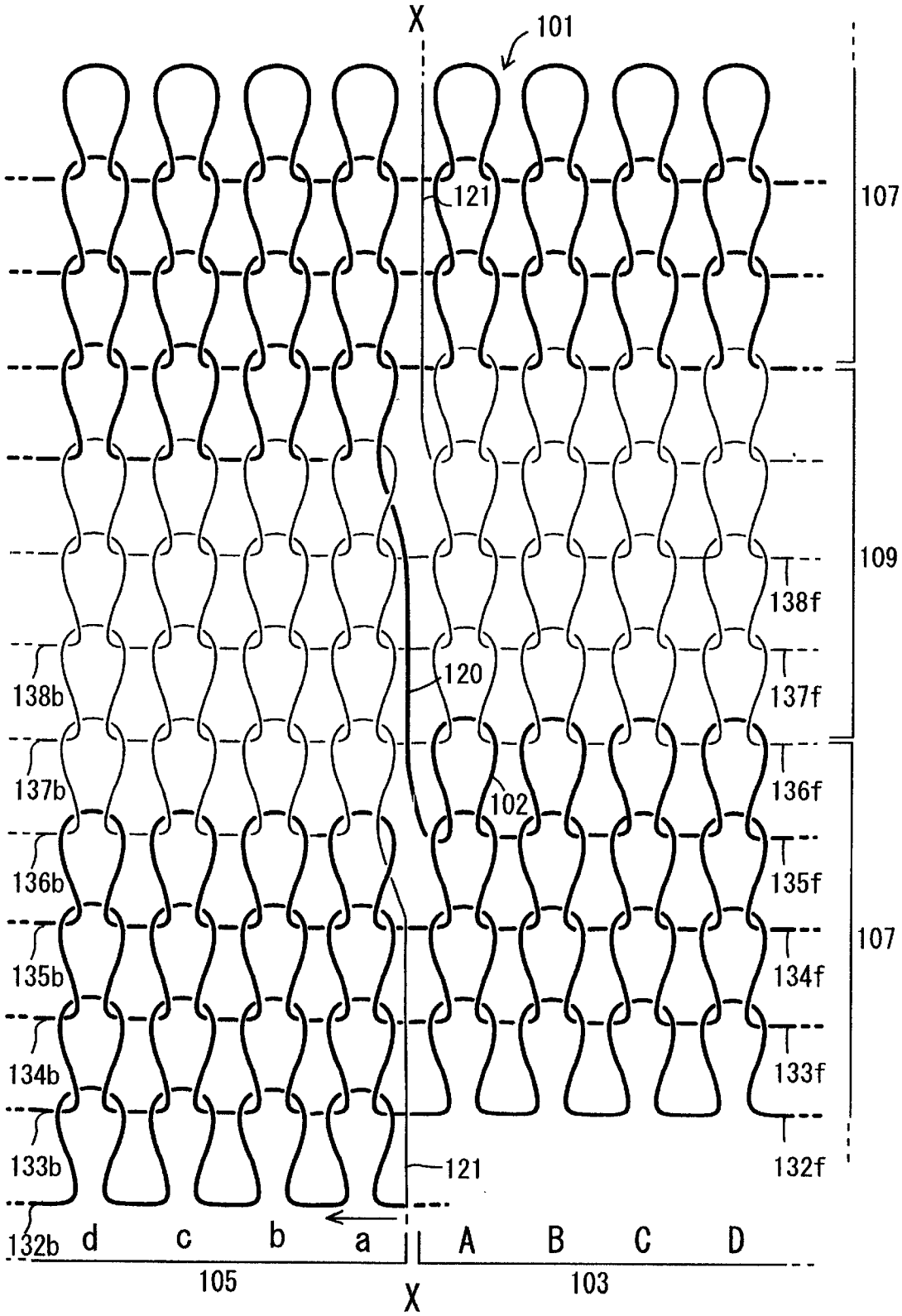
FIG. 7 is a loop diagram corresponding to FIG. 6 showing the loops put in their natural state after knitting.

A two-tone striped pattern of a tubular fabric comprising a first knitted fabric part and a second knitted fabric part which are knitted into a tubular form as a preferred embodied form of the present invention will be described with reference to the accompanying drawings. FIGS. 1–3 illustrate the knitting steps of a plain-knitted tubular fabric having a stripe pattern knitted in the method of this embodiment. In the diagrams, horizontal arrows indicate a traveling direction of the yarn feeder; and vertical arrows indicate a stitch transfer direction. "F" indicates a front needle bed; "B" indicates a back needle bed; "A–Q" indicate knitting needles of the front needle bed; and "a–q" indicate knitting needles of the back needle bed. A front fabric 3 forming a tubular fabric 1 is knitted with the knitting needles of the front needle bed, and a back fabric 5 is knitted with the knitting needles of the back needle bed. FIG. 4 illustrates the loop structure around the yarn switching point of the tubular fabric 1. The step S illustrates the state in which the stitches of the tubular fabric 1 are retained on the needle bed. The front fabric 3 is retained on the needles C–Q of the front needle bed, and the back fabric 5 is retained on the needles c–q of the back needle bed. It is to be noted that for convenience of explanation, a fewer number of needles used for the knitting than the actual number of needles is illustrated.

A first knitted fabric part 7 of the stripe pattern is knitted with a knitting yarn 11 in the following steps 1–6. In the step 1, a yarn feeder (not shown) of the knitting yarn 11 is shifted rightwards to feed the yarn to the needles c–q of the back needle bed, so as to knit the loop course 31*b* of the back fabric 5. In the step 2, the yarn is fed to the needles Q–C of the front needle bed to knit the loop course 31*f* of the front fabric 3 next to the loop course of the back fabric 5. The knitting of the steps 1 and 2 is repeated a predetermined number of times to knit desired courses of loops of the first knitted fabric part 7.

The next steps 3–6 illustrate the knitting for hiding the stitch level difference produced at the yarn switching point. In this embodiment, these knitting steps are taken in the last two courses 32*f*, 33*f* of the front fabric 3 on the cast-off side. First, in the step 3, the yarn is fed to the needles c–q of the back needle bed to knit the loop course 32*b* of the back fabric 5, and then in the step 4, the yarn is fed to the needles Q–D of the front needle bed, except the needle C at the end of the front needle bed, to knit the loop course 32*f* of the front fabric 3. In the step 5, the yarn is fed to the needles c–q of the back needle bed to knit the last loop course 33*b* of the back fabric 5. In the sequent step 6, the yarn is fed to the needles Q–E and C of the front needle bed, except the needle D of the front needle bed, to knit the last loop course 33*f* of the front fabric 3.

The steps 7–24 illustrate the knitting for disposing an unused yarn edge including a cross-yarn part 72. The yarn-out process of the yarn 11 is performed after the completion of the knitting of the first knitted fabric part 7 is disposed, first, and, then, the yarn-in knitting of the yarn 13 is performed before the start of the knitting of the second knitted fabric part 9. In parallel with the unused yarn edge disposing knitting, the knitting for preventing loosening of stitches is performed.

The steps 7–14 illustrate the knitting for disposing an unused yarn edge of the yarn 11.

In the step 7, the yarn 11 is hooked on the needle b of the back needle bed, first, and, then, in the next step 8, the yarn is hooked on the needle A of the front needle bed, to form tuck loops 41, 42 thereon, respectively. Then, in the step 9, the tuck loop 41 retained on the needle b of the back needle bed is transferred to the needle B of the front needle bed. In the next step 10, the yarn 11 is fed to the needle B of the front needle bed to form a loop 43 sequent to the tuck loop 41. As a result of this, the tuck loop 41 that is knocked over across the loop 43 from the needle B of the front needle bed closes the loop 43 at its feet to fix a ring of the loop 43. In the step 11, the loop 43 is transferred to the needle c of the back needle bed and laid over a loop 50 in the course 33*b* of the back fabric 5. The loop formed to dispose the unused yarn edge is laid over a given loop in the fabric and then is woven into the fabric in the sequent course knitting, to prevent the stitches of the fabric from loosening therefrom. This knitting method is disclosed in detail by Japanese Laid-open (Unexamined) Patent Publication No. Hei 8 (1996)-188942.

It should be noted that when the last part of the front fabric 3 is knitted up, the loop 43 formed to dispose the unused yarn edge is laid over a loop located downstream of a loop 51 (in this case, the loop 50 of the back fabric 5), to prevent the loops 51 and 52 from being split to produce a hole therebetween. In the step 12, the needle A of the front needle bed is moved back and forth to knock off the tuck loop 42 as was hooked in the step 8 from the needle A.

In the step 13, the loops retained on the needles C, D and E of the front needle bed are transferred to and retained on the needles of the opposed needle bed. The loops of the back fabric 5 are already retained on the needles c, d and e of the opposed back needle bed. In the illustration, there is illustrated the knitting provided by the so-called four-bed type flat knitting machine comprising another pair of needle beds arranged over the front and back needle beds. The loops retained on the needles C, D and E are transferred to and retained on the needles c, d and e of the opposed upper back needle bed BU. This knitting can be provided, for example, by using the computer-controlled flat knitting machine (Product name: SWG-X) available from SHIMA SEIKI MFG., LTD. In the case where a general-purpose two-bed type flat knitting machine having no upper needle beds is used, for example, the front fabric is knitted with odd needles and the back fabric is knitted with even needles so that the front and back fabrics can be knitted in the form of the tubular fabric, and empty needles are reserved for loop transfer on the opposed needle beds so that the loops retained on the needles C, D and E can be transferred to those empty needles. In the case where the flat knitting machine including slide needles each formed by combining two thin plates, such as the computer-controlled flat knitting machine (Product name: FIRST) available from SHIMA SEIKI MFG., LTD., is used, the knitting can be provided by using the so-called holding technique for holding a loop temporarily on the slide needle disclosed by Japanese Laid-open (Unexamined) Patent Publication No. Hei 11(1999)-

43849. In this holding technique, the loops of the back fabric are retained in the hooks of the needles and the loops retained on the needles C, D and E are held on the sliders of those needles. Thus, the knitting in the step 13 is selectively determined depending on the type of flat knitting machine used. In the step 14, the yarn feeder is shifted leftwards to let the yarn 11 out.

The next steps 15–24 illustrate the knitting for disposing an unused yarn edge of a yarn 13 on the cast-on side which is to be subjected to the yarn-in operation for knitting the second knitted fabric part 9. In the step 15, the yarn feeder is shifted to at least the right of the needle F so that the yarn 13 can be within the knitting width. Then, in the step 16, the loops of the front fabric 3 as were transferred to the back needle bed in the step 13 are transferred back to the original needles C, D and E. As a result of this, the yarn 11 drawn out runs horizontally through the inside of the tubular fabric to the outside of the tubular fabric, extending in the exposed state from between adjacent loops of the loop course 34*f* formed by the needles E and F toward the yarn feeder stopped at the outside at the left side of the fabric. On the other hand, the yarn 13 drawn in is inserted in the inside of the tubular fabric from the outside of the tubular fabric, passing through between the adjacent loops formed by the needles E and F. As a result of this, the cross-over yarn parts 71, 72 of the yarns 11, 13 extending between the first knitted fabric part 7 and the second knitted fabric part 9 are shifted horizontally from the yarn switching points; then come out of hiding of the tubular fabric from between the adjacent loops formed by the needles E and F; and then extend vertically in an alternate order, as shown in FIG. 4.

In the step 17, the yarn 13 is moved leftwards. Then, in the step 18, the yarn 13 is hooked by the needle B of the front needle bed and in the next step 19, the yarn 13 is hooked by the needle a of the back needle bed, to form the tuck loops 45, 46. Then, in the step 20, the tuck loop 45 retained on the needle B of the front needle bed is transferred to the needle b of the back needle bed. In the next step 21, the yarn 13 is fed to the needle b of the back needle bed to form a loop 47 sequent to the tuck loop 45. In the step 22, the loop 47 is transferred to the needle C of the front needle bed and laid over the loop 51 of the course 33*f* of the front fabric 3. Thus, prior to the start of knitting of the back fabric 5, the loop 47 formed to dispose the unused yarn edge is laid over the loop located upstream of the loop 54 with respect to the knitting direction (in this case, the loop 51 of the front fabric 3), to prevent formation of the undesirable hole between the loop 51 and the loop 58 formed in the sequent course. Then, in the step 23, the needle a of the back needle bed is moved back and forth to knock off the tuck loop 46 as was formed in the step 19 from the needle a, and then in the step 24, the yarn feeder is shifted leftwards to put the yarn outside of the fabric 1.

The next steps 25–28 illustrate the knitting for hiding the stitch level difference produced at the yarn switching point. First, in the step 25, the yarn 13 is fed to the needles d–q of the back needle bed, except the needle c, to knit the loop course 34*b* of the back fabric 5. Thereafter, in the step 26, the yarn is fed to the needles Q–C of the front needle bed to knit the loop course 34*f* of the same course of the front fabric 3. As a result of a loop 57 being formed on the needle C, the loop 47 formed in the leading edge portion of the yarn 13 retained on the needle C is woven in the fabric, together with the loop 51 and thus is prevented from loosening. In the step 27, the yarn 13 is fed to the needles c and e–q of the back needle bed, except the needle d, to knit the loop course 35*b* of the back fabric 5, and in the sequent step 28, the yarn is fed to the needles Q–C of the front needle bed, to knit the loop course 35*f* of the same course of the front fabric 3. As a result of a loop 55 being formed on the needle c, the loop 43 formed in the terminal edge portion of the yarn 11 retained on the needle c is woven in the fabric, together with the loop 50 and thus is prevented from loosening. The knitting in the sequent steps 29 and 30 is repeated a predetermined number of times to knit desired number of courses of the second knitted fabric part 9. The next steps 31–34 illustrate the knitting using the yarn 13 for hiding the stitch level difference produced at an end of the second knitted fabric part 9 on a cast-off side thereof. This knitting is performed in the same manner as the knitting using the yarn 11 in the steps 3–6.

The steps 35–42 illustrate the knitting for disposing an unused yarn edge of the yarn 13. This knitting in these steps is performed in the same manner as in the steps 7–14 using the yarn 11. Thereafter, the first knitted fabric part 7 and the second knitted fabric part 9 are alternately knitted, at yarn switching points of which the knitting for hiding the stitch level difference and the knitting for disposing the unused yarn edge are performed, though not shown.

In the illustrated embodiment, the following method is taken to put the stitch level difference produced at the yarn switching point in the shade. For the yarn-out operation, the knitting is terminated in such a condition that the two loops (the needles C and D) located at the side end of the front fabric 3 bordered with the back fabric 5 are each missed once, with their courses changed. On the other hand, for the yarn-in operation, the knitting is started in such a condition that the two loops (the needles c and d) located at the side end of the back fabric 5 bordered with the front fabric 3 are each missed once, with their courses changed. As a result of this, the number of courses of the front fabric 3 formed with the needles C and D of the front needle bed and the number of courses of the back fabric 5 formed with the needles c and d of the back needle bed becomes fewer than those formed with the remaining needles, as shown in FIG. 4. As a result of this, the loops formed before and after the miss are drawn in each other, and as such can allow those loops to be finally deformed in the boundary by the tensile force of the knitted fabric itself so as to make the stitch level difference obscure.

As mentioned above, the yarns 11, 13 subjected to the yarn-in process and the yarn-out process are prevented from loosening at their ends on the cast-off side and cast-on side and also the cross-over yarn parts 71, 72 are extended as if a horseshoe-like shape is drawn, extending horizontally from the yarn switching point through the inside of the tubular fabric, then coming out of hiding of the tubular fabric and extending vertically, then being drawn in the inside of the tubular fabric again, and then extending horizontally toward the next yarn switching point. As a result of this, when the cross-over yarn parts coming out of hiding of the tubular fabric are cut to dispose the unused yarn edges and then the knitted fabric is stretched, the cross-over yarn parts coming to the surface are easily drawn and hidden in the knitted fabric. Thus, the unused yarn edges can be disposed with ease and with efficiency.

Variants

In order to minimize the stitch level difference produced at the yarn switching point, the embodiment illustrated above adopts the method wherein when the last two courses 32*f*, 33*f* of the front fabric 3 on a cast-off side thereof are knitted, the needles C, D are put in the miss position in the alternate order, while on the other hand, when the first two courses 34*b*, 35*b* of the back fabric 5 on a cast-on side thereof are knitted, the needles c, d are put in the miss position in the alternate order. Instead of this method, another method may be adopted wherein the needles D, D are put in the miss position in the last course 33*f* and the needles c, d are put in the miss position in the course 34*b* on the cast-on side. Alternatively, the order in which the needles C, D, c, d are put in the miss position may be counter-changed. When the needles C, D, c, d are put in the miss position, the yarns are not woven in the knitted fabric, for the reason of which the stitch level difference can be put into obscurity, as compared with when the needles are put in the tuck position. The needles C, D, c, d may be put in the tuck position, however. Further, the needles C, D, c, d may be put in the combined position of the miss and the tuck.

Instead of this, the needle C may be put in the miss position to miss one loop in the loop course 33*f* on the cast-off side and the needle c may be put in the miss position to miss one loop in the loop course 34*b* on the case-on side. Alternatively, the needles to be put in the miss position in the boundary may be gradually increased in number in the order of three, four, . . . . In this variant, the stitch level differences in that range are gradually absorbed to the extent corresponding to the increased number of needles put in the missed position. Thus, the effect of putting the stitch level differences into obscurity can be expected. In addition, only the needle in the boundary on either of the cast-off side and the cast-on side may be put in the miss position.

While in the embodiment illustrated above, the yarn switching point is positioned in the boundary between the front fabric and back fabric forming the tubular fabric, or at the side end of the knitting width, when viewed from on the needle bed, it is needless to say that the knitting method of the present invention may be effected even when the yarn switching position is positioned, for example, in a central portion of the front fabric, without limiting to the side end of the knitting width. In that case, the knitting for disposing the unused yarn edge may be provided by reserving empty needles for that knitting, depending on the type of knitting machine used, in the same manner as in the step 13 illustrated above.

While in the embodiment illustrated above, the loop 43 formed to dispose the unused yarn edge for casting off stitches is laid over the loop 50 located downstream of the loop 51, the loop 43 may be laid over another loop, such as the loop 53 or the loop 55 in the next course, as long as such a loop is located downstream thereof with respect to the knitting direction. Likewise, while the loop 47 formed to dispose the unused yarn edge for casting on stitches is laid over the loop 51 located upstream of the loop 54 with respect to the knitting direction, the loop 47 may alternatively be laid over another loop, such as the immediate loop 50 or the loop 55 in the next course, as long as such a loop is located upstream thereof. For aesthetic preference, it is preferable that the loops laid over each other are formed from the same yarn. In short, it is essential that the loop formed to dispose the unused yarn edge is laid over the downstream located loop for the casting off or over the upstream located loop for the casting on, in order to prevent going out of existence of the interconnection of the loops in the direction of the course at the casting-off or at the casting-on and thereby prevent forming any undesirable hole thereat.

For the tubular fabric having the repeatedly formed stripped patterns, it is preferable that the yarn switching point is shifted in each pattern to avoid repetition of the miss or the tuck knitting for making the stitch level difference obscure by using the same needle, so as not to excessively reduce the number of loop courses in that wale, as compared with that in the other wale.

Capabilities of Exploitation in Industry

According to the present invention, the number of courses of the wale bordering on the yarn switching point is reduced more than the number of courses of the other wale and, as a result of this, the loops formed in the course knitting before and after the miss or the tuck knitting are pulled in each other vertically and thus stretched to put the color difference produced at the yarn switching point in the shade, and as such can prevent disfigurement of the knitted product.

What is claimed is:

1. A method of knitting a stripe pattern in a tubular fabric by using a flat knitting machine comprising at least a pair of front and back needle beds, wherein a front fabric and a back fabric are suspended in layers from the needle beds and their loop courses are cyclically knitted in an alternate order so as to be joined together at each widthwise end thereof, so as to form the tubular fabric, said method comprising:

performing a yarn switching to form the stripe pattern whenever predetermined courses are knitted, said stripe pattern comprising at least a first knitted fabric part and a second knitted fabric part; and missing and/or tucking a loop of at least either of the first knitted fabric part and the second knitted fabric part at a yarn switching point in a boundary between the first knitted fabric part and the second knitted fabric part, to minimize a stitch level difference between a stitch level of the boundary and a stitch level of the first knitted fabric part and the second knitted fabric part, produced at that point.

2. The method of knitting the stripe pattern in the tubular fabric according to claim 1, wherein at least one loop of adjacent loops in each of the first knitted fabric part and the second knitted fabric part is missed at the yarn switching point.

3. The method of knitting the stripe pattern in the tubular fabric according to claim 2, wherein two loops of the adjacent loops in each of the first knitted fabric part and the second knitted fabric part are missed at the yarn switching point.

4. The method of knitting the stripe pattern in the tubular fabric according to claim 3, wherein one of the two loops located at the yarn switching point is missed in the knitting of the second to the last course of the first knitted fabric part; then the other of the two loops is missed in the last course of the same; then one of the two loops is missed in the knitting of the first course of the second knitted fabric part knitted subsequently; and then the other of the two loops is missed in the sequent knitting of the course of the same.

5. The method of knitting the stripe pattern in the tubular fabric according to claim 1, which includes the unused yarn edge disposal knitting step that loops to dispose unused yarn edges are formed in the first and second knitted fabric parts at portions thereof in proximity of casting-on and casting-off by using empty needles and then the loops thus formed are laid over given loops in the tubular fabric.

6. The method of knitting the stripe pattern in the tubular fabric according to claim 5, wherein the loops, which are formed in the knitted fabric parts on casting-off side thereof to dispose unused yarn edges, are laid over the downstream located loops with respect to the knitting direction, and the loops, which are formed in the knitted fabric parts on casting-on side thereof to dispose unused yarn edges, are laid over the upstream located loops with respect to the knitting direction.

7. A method of knitting a stripe pattern in a tubular fabric by using a flat knitting machine comprising at least a pair of front and back needle beds, wherein a front fabric and a back fabric are suspended in layers from the needle beds and their loop courses are cyclically knitted in an alternate order so as to be joined together at each widthwise end thereof, so as to form the tubular fabric; and wherein a yarn switching is performed to knit the stripe pattern comprising at least a first knitted fabric part and a second knitted fabric part, the method comprising the steps:

a) that a loop of the first knitted fabric part at a portion thereof on a casting-off side next to the second knitted fabric part to be knitted next is missed and/or tucked; and b) that a loop of the second knitted fabric part at a portion thereof on a casting-on side next to the first knitted fabric part is missed and/or tucked in succession to said step.

8. A tubular fabric with a stripe pattern wherein a front fabric and a back fabric are cyclically knitted so as to be joined together at each widthwise end thereof; wherein the stripe pattern comprising at least a first knitted fabric part and a second knitted fabric part is formed in such a manner that whenever a predetermined courses are knitted, two different yarns of a first yarn and a second yarn are switched to each other alternately; and wherein at least either of the first knitted fabric part and the second knitted fabric part is missed and/or tucked at a yarn switching point in a boundary between the first knitted fabric part and the second knitted fabric part.

9. The tubular fabric with a stripe pattern according to claim 8, wherein at least one loop of adjacent loops in each of the first knitted fabric part and the second knitted fabric part is missed at the yarn switching point.

10. The tubular fabric with a stripe pattern according to claim 9, wherein two loops of the adjacent loops in each of the first knitted fabric part and the second knitted fabric part are missed at the yarn switching point in such a manner that one of the two loops is missed in the second to last course of the first knitted fabric part; then the other of the two loops is missed in the last course of the same; then one of the two loops is missed in the first course of the second knitted fabric part knitted subsequently; and then the other of the two loops is missed in the sequent loop course of the same.

* * * * *